US007992973B2

(12) United States Patent
Morozumi et al.

(10) Patent No.: US 7,992,973 B2
(45) Date of Patent: Aug. 9, 2011

(54) LIQUID EJECTING HEAD, LIQUID EJECTING APPARATUS, AND PIEZOELECTRIC ELEMENT

(75) Inventors: Koichi Morozumi, Suwa (JP); Jiro Kato, Suwa (JP); Satoshi Denda, Suwa (JP); Ichiro Asaoka, Chino (JP)

(73) Assignee: Seiko Epson Corporation, Tokyo (JP)

( * ) Notice: Subject to any disclaimer, the term of this patent is extended or adjusted under 35 U.S.C. 154(b) by 217 days.

(21) Appl. No.: 12/501,714

(22) Filed: Jul. 13, 2009

(65) Prior Publication Data

US 2010/0007706 A1 Jan. 14, 2010

(30) Foreign Application Priority Data

Jul. 14, 2008 (JP) ..... 2008-182384

(51) Int. Cl.
*B41J 2/045* (2006.01)

(52) U.S. Cl. ..... 347/71

(58) Field of Classification Search ..... None
See application file for complete search history.

(56) References Cited

FOREIGN PATENT DOCUMENTS

JP 2007-173604 7/2007

*Primary Examiner* — Matthew Luu
*Assistant Examiner* — Lisa M Solomon
(74) *Attorney, Agent, or Firm* — Workman Nydegger

(57) ABSTRACT

A liquid ejecting head includes a pressure generating chamber communicating with a nozzle opening, and a piezoelectric element generating a pressure change in the pressure generating chamber. In this liquid ejecting head, the piezoelectric element includes a first electrode, a piezoelectric layer provided above the first electrode, and a second electrode provided above the piezoelectric layer at a side opposite to the first electrode. The first electrode has a diffusion-preventing layer containing iridium oxide as a primary component, and the diffusion-preventing layer has stress relieving holes that pass through in the thickness direction thereof and that is filled with a material other than iridium oxide.

9 Claims, 10 Drawing Sheets

LIQUID EJECTING HEAD, LIQUID EJECTING APPARATUS, AND PIEZOELECTRIC ELEMENT

CROSS-REFERENCE TO RELATED APPLICATIONS

This application claims the benefit of priority to Japanese Patent Application No. 2008-182384 filed Jul. 14, 2008, the contents of which are hereby incorporated by reference in their entirety.

BACKGROUND

1. Technical Field

The present invention relates to a liquid ejecting head ejecting a liquid from a nozzle opening, a liquid ejecting apparatus, and a piezoelectric element having a first electrode, a piezoelectric layer, and a second electrode.

2. Related Art

A piezoelectric element used for a liquid ejecting head or the like is an element including two electrodes and a dielectric film provided therebetween, the dielectric film including a piezoelectric material that has an electromechanical transducing function, and the dielectric film is formed, for example, of a crystallized piezoelectric ceramic.

The piezoelectric element as described above is formed by the steps of forming a lower electrode film on one surface of a substrate (flow path forming substrate) by a sputtering method, forming a piezoelectric layer on the lower electrode film by a sol-gel method, a metal-organic decomposition (MOD) method, or the like, forming an upper electrode film on the piezoelectric layer by a sputtering method, and then patterning the piezoelectric layer and the upper electrode film.

In addition, as the lower electrode film of the piezoelectric element, a film including a diffusion-preventing layer composed of iridium oxide has been proposed (for example, see JP-A-2007-173604).

The diffusion-preventing layer composed of iridium oxide may be formed by sputtering of iridium, followed by thermal oxidation; however, when iridium is oxidized, since its volume is expanded by approximately 2.3 times, after the piezoelectric layer is crystallized by firing, the diffusion-preventing layer imparts a large stress to the piezoelectric layer. As a result, the durability of the piezoelectric layer is degraded, and breakage thereof may disadvantageously occur.

In addition, although an iridium oxide film may be directly formed by sputtering, it is difficult to stably and continuously perform sputtering of an oxide. As a result, an oxide having desired thickness, density, and the like cannot be obtained, and the cost is also unfavorably increased.

In addition, the problems described above are not limited to a piezoelectric element used for an ink jet recording head, and piezoelectric elements used for liquid ejecting heads ejecting other types of liquids and piezoelectric elements used for devices other than liquid ejecting heads also have the above problems.

SUMMARY

An advantage of some aspects of the invention is to provide a liquid ejecting head having a piezoelectric element that prevents a piezoelectric layer from being broken and that has improved durability, a liquid ejecting apparatus, and a piezoelectric element.

According to one aspect of the invention, there is provided a liquid ejecting head including: a pressure generating chamber communicating with a nozzle opening ejecting a liquid; and a piezoelectric element generating a pressure change in the pressure generating chamber. In this liquid ejecting head, the piezoelectric element includes a first electrode, a piezoelectric layer provided on the first electrode, and a second electrode provided on the piezoelectric layer at a side opposite to the first electrode, the first electrode has a diffusion-preventing layer containing iridium oxide as a primary component, and the diffusion-preventing layer has stress relieving holes that pass through in the thickness direction thereof and that are filled with a material other than iridium oxide.

According to the aspect described above, even when iridium is oxidized to form the diffusion-preventing layer, the stress of volume expansion caused by oxidation can be relieved by the stress relieving holes. As a result, the stress of the diffusion-preventing layer applied to other laminate films is decreased, so that delamination, breakage of the piezoelectric layer, degradation in durability, and the like can be prevented.

It is preferable that the diffusion-preventing layer of the first electrode be provided at a piezoelectric layer side, and that the above liquid ejecting head further include a crystalline seed layer containing titanium oxide as a primary component between the diffusion-preventing layer and the piezoelectric layer. In addition, the first electrode preferably has a titanium oxide region that contains titanium oxide as a primary component and that is in contact with the crystalline seed layer through the stress relieving holes. As a result, excess titanium of the piezoelectric layer at a first electrode side can be easily discharged to a titanium oxide region side, and the piezoelectric layer can be formed to have uniform piezoelectric properties in the thickness direction thereof.

In addition, the first electrode preferably further has a platinum layer containing platinum as a primary component. Accordingly, the conductivity of the first electrode is not degraded even when the piezoelectric layer is fired, so that the conductivity of the first electrode can be ensured.

In addition, as the piezoelectric layer, a material containing lead is preferably used, and lead titanate zirconate is preferably used. By using the material as described above, a liquid ejecting head including a piezoelectric element excellent in piezoelectric properties can be realized.

Furthermore, according to another aspect of the invention, there is provided a liquid ejecting apparatus including the liquid ejecting head described above. According to this aspect, a liquid ejecting apparatus including a liquid ejecting head excellent in liquid injection properties and durability can be realized.

In addition, according to still another aspect of the invention, there is provided a piezoelectric element including: a first electrode; a piezoelectric layer provided on the first electrode; and a second electrode provided on the piezoelectric layer at a side opposite to the first electrode. In this piezoelectric element, the first electrode has a diffusion-preventing layer containing iridium oxide as a primary component, and the diffusion-preventing layer has stress relieving holes that pass through in the thickness direction thereof and that are filled with a material other than iridium oxide.

According to the aspect described above, even when iridium is oxidized to form the diffusion-preventing layer, the stress of volume expansion caused by oxidation can be decreased by the stress relieving holes. As a result, the stress of the diffusion-preventing layer applied to other laminate films is decreased, so that delamination, breakage of the piezoelectric layer, degradation in durability, and the like can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail with reference to embodiments.

Embodiment 1

Figure 1:
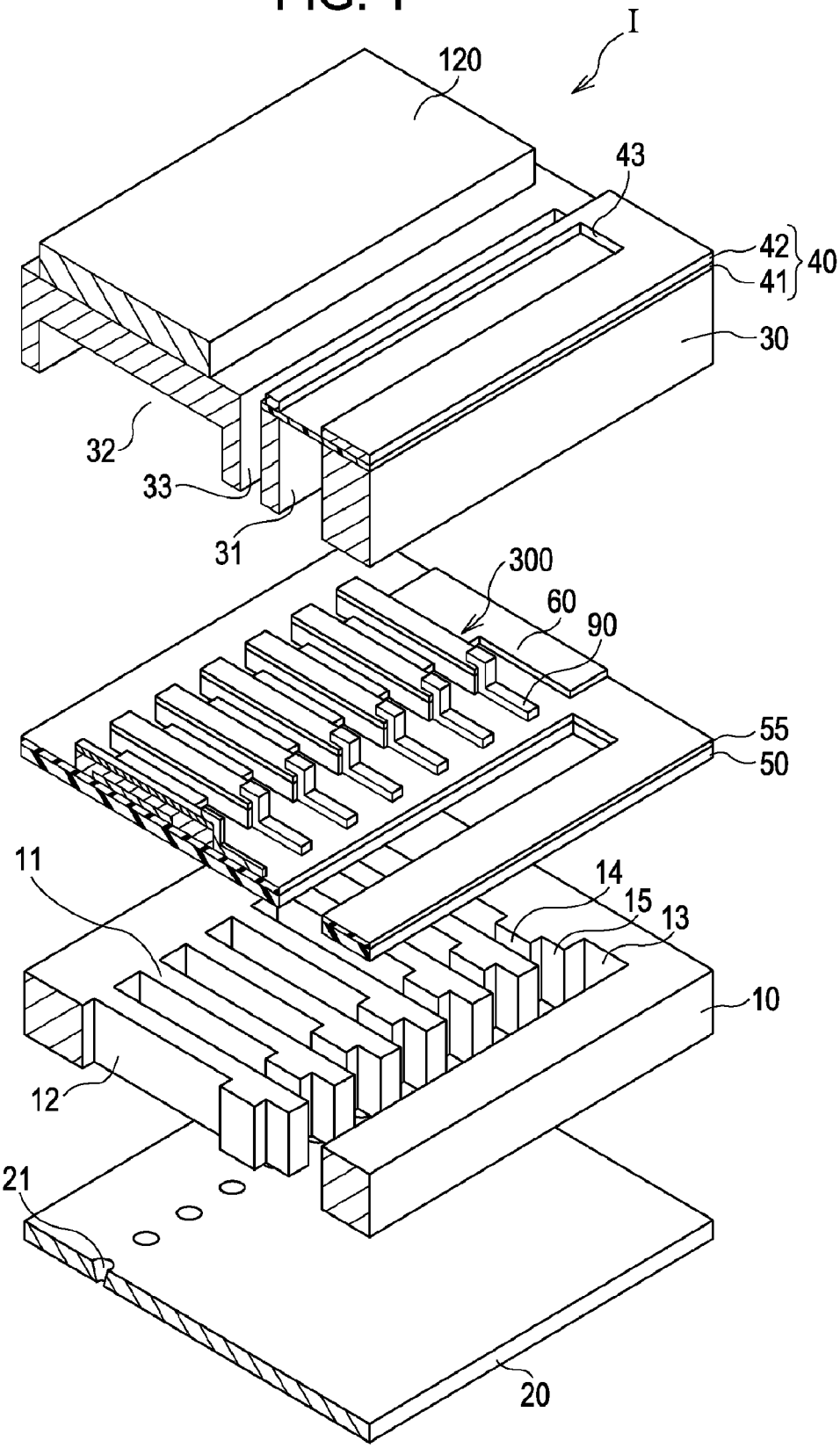
FIG. 1 is an exploded perspective view showing a schematic structure of a recording head according to Embodiment 1 of the invention.
Figure 2A:
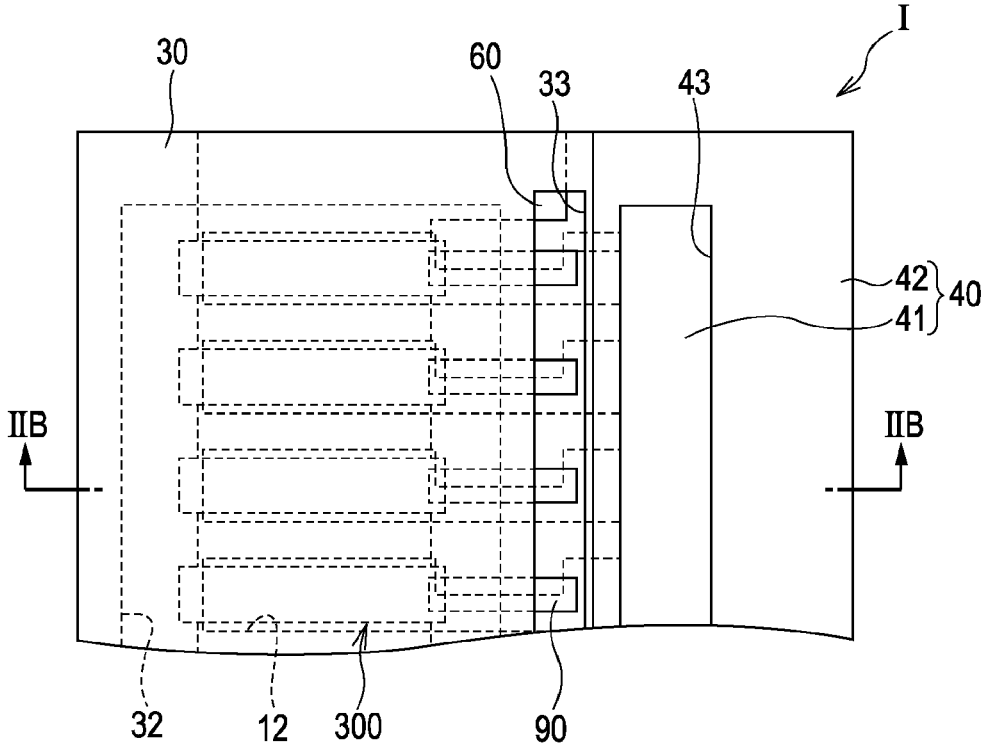
FIG. 2A is a plan view of the recording head according to Embodiment 1 of the invention.
Figure 2B:
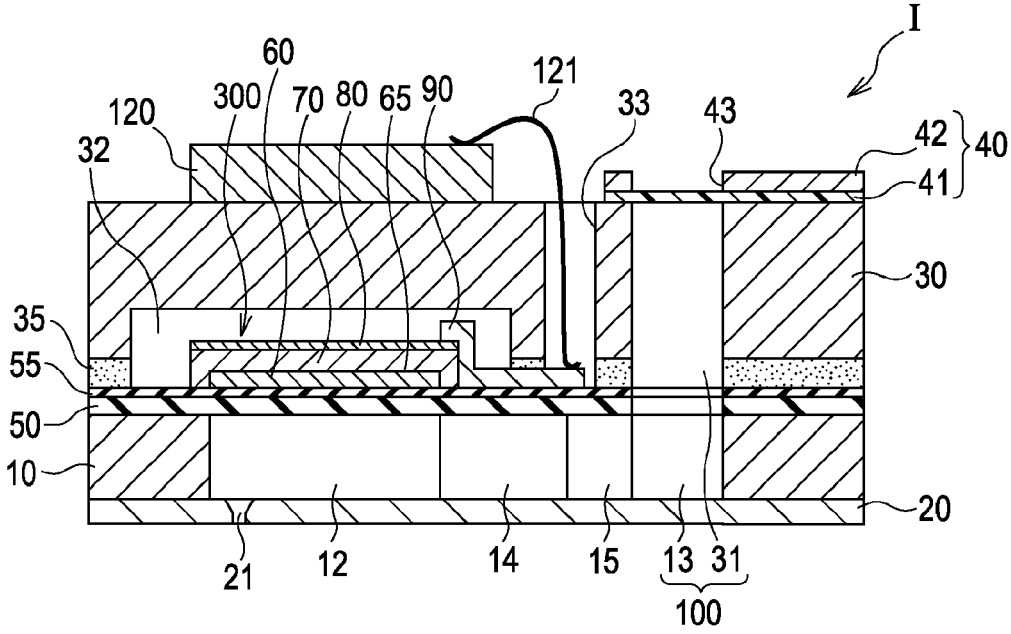
FIG. 2B is a cross-sectional view of the recording head according to Embodiment 1 of the invention.
Figure 3:
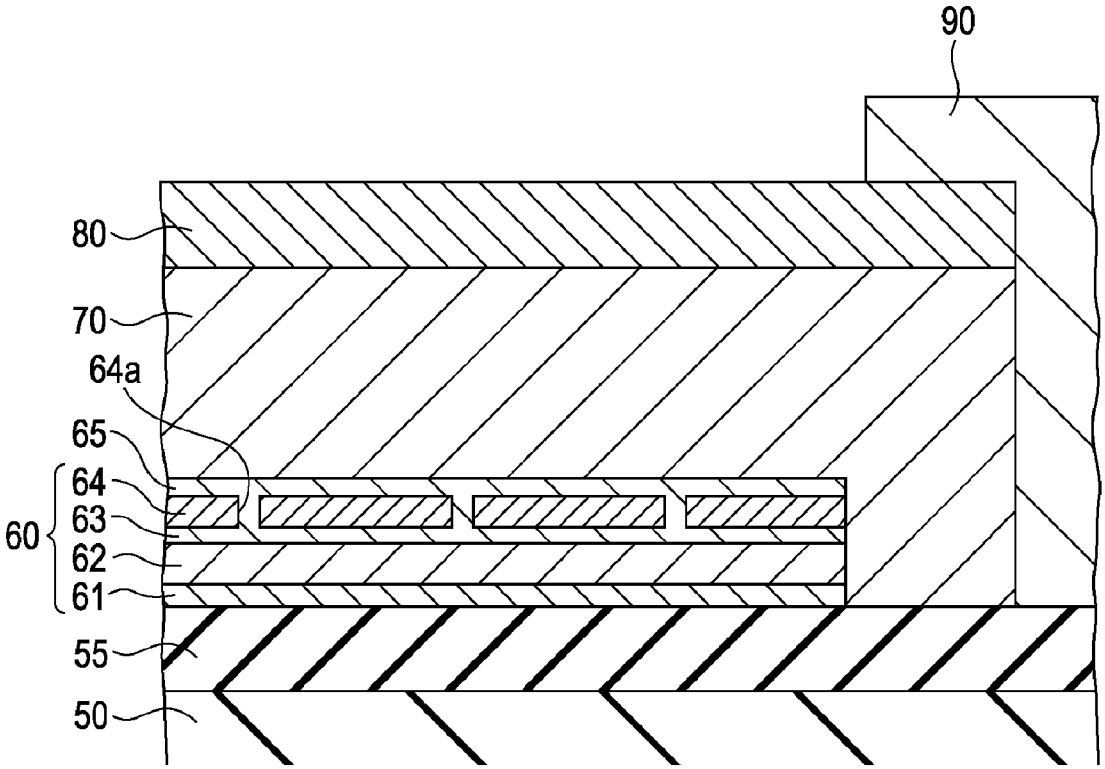
FIG. 3 is an enlarged cross-sectional view showing an important portion of the recording head according to Embodiment 1 of the invention.

FIG. 1 is an exploded perspective view showing a schematic structure of an ink jet recording head I which is one example of a liquid ejecting head according to Embodiment 1 of the invention; FIG. 2A is a plan view of FIG. 1; FIG. 2B is a cross-sectional view taken along the line IIB-IIB of FIG. 2A; and FIG. 3 is an enlarged cross-sectional view showing an important portion of the ink jet recording head I.

As shown in FIGS. 1, 2A, and 2B, a flow path forming substrate 10 of this embodiment is composed of a silicon single crystal substrate, and an elastic film 50 composed of silicon dioxide is formed on one surface of the substrate 10.

In the flow path forming substrate 10, pressure generating chambers 12 are provided in parallel in the width direction thereof. In addition, a communicating portion 13 is formed in an outside region in the longitudinal direction of the pressure generating chambers 12 of the flow path forming substrate 10 to communicate with the pressure generating chambers 12 through ink supply paths 14 and communicating paths 15, which are provided for the respective pressure generating chambers 12. The communicating portion 13 communicates with a reserve portion 31 of a protective substrate, which will be described later, to form a part of a reserver used as a common ink room for the pressure generating chambers 12. The ink supply path 14 is formed to have a width smaller than that of the pressure generating chamber 12 to maintain a flow-path resistance of ink constant, the ink flowing into the pressure generating chamber 12 from the communicating portion 13. Although the ink supply path 14 is formed by narrowing the width of the flow path from one of two side walls thereof in this embodiment, the ink supply path may be formed by narrowing the width of the flow path from the two side walls thereof. In addition, instead of narrowing the width of the flow path, the ink path may be formed by narrowing the flow path in the thickness direction.

In this embodiment, in the flow path forming substrate 10, liquid flow paths each formed of the pressure generating chamber 12, the communicating portion 13, the ink supply path 14, and the communicating path 15 are formed.

In addition, a nozzle plate 20 having nozzle openings 21 is fixed to an open surface side of the flow path forming substrate 10 with an adhesive, a heat sealing film, or the like, the nozzle openings 21 being formed to communicate with the respective pressure generating chambers 12 in the vicinities of end portions thereof opposite to the ink supply paths 14. In this case, the nozzle plate 20 is formed, for example, of a glass ceramic, a silicon single crystal substrate, or stainless steel.

In addition, at an opposite side to the open surface of the flow path forming substrate 10, the elastic film 50 is formed as described above, and an insulating film 55 is formed on this elastic film 50. Furthermore, on this insulating film 55, at least one first electrode 60, piezoelectric layers 70, and at least one second electrode 80 are laminated to each other by a process, which will be described later, to form piezoelectric elements 300. In this embodiment, the piezoelectric element 300 is a portion including the first electrode 60, the piezoelectric layer 70, and the second electrode 80. In general, one of the electrodes of the piezoelectric element 300 is used as a common electrode, and the other electrodes and the piezoelectric layers 70 are formed by patterning for the respective pressure generating chambers 12. In this embodiment, the first electrode 60 is used as the common electrode of the piezoelectric elements 300, and the second electrodes 80 are used for the respective piezoelectric elements 300; however, the first electrode 60 and the second electrode 80 may be used in an opposite manner to that described above for some reasons relating to a drive circuit, wires, arrangements thereof, and the like. In addition, in this embodiment, the piezoelectric element 300 and a vibrating plate that generates displacement by the drive thereof are collectively called an actuator device. In the above example, the elastic film 50, the insulating film 55, and the first electrode 60 function as a vibrating plate; however, of course, the vibrating plate is not limited thereto and for example, the first electrode 60 may only be used as the vibrating plate without providing the elastic film 50 and the insulating film 55. In addition, the piezoelectric element 300 itself may also be actually used as the vibrating plate.

The piezoelectric layer 70 is formed on the first electrode 60 from a piezoelectric material having an electromechanical transducing function, and in particular, among the piezoelectric materials, the piezoelectric layer 70 is formed from a ferroelectric material having a perovskite structure and including Pb, Zr, and Ti as a metal. For the piezoelectric layer 70, for example, there may be preferably used a ferroelectric material, such as lead zirconate titanate (PZT), and a compound formed by adding an metal oxide, such as niobium oxide, nickel oxide, or magnesium oxide, to the above ferroelectric material. In particular, for example, lead titanate ($PbTiO_3$), lead zirconate titanate ($Pb(Zr,Ti)O_3$), lead zirconate ($PbZrO_3$), lead lanthanum titanate ($(Pb,La)TiO_3$), lead lanthanum zirconate titanate ($(Pb,La)(Zr,Ti)O_3$), and lead zirconate titanate magnesium niobate ($Pb(Zr,Ti)(Mg,Nb)O_3$) may be used.

The piezoelectric layer 70 is formed to have a small thickness so as not to generate cracks in a manufacturing process and to have a large thickness so as to exhibit sufficient displacement characteristics. For example, in this embodiment, the piezoelectric layer 70 is formed to have a thickness of approximately 1 to 2 μm.

In addition, the first electrode 60 has a diffusion-preventing layer 64 including iridium oxide ($IrO_x$) as a primary component. In this embodiment, as shown in FIG. 3, the first electrode 60 includes, from a flow path forming substrate 10 side, an adhesion layer 61 containing titanium oxide as a primary component, a platinum layer 62 provided on the adhesion layer 61 and containing platinum (Pt) as a primary component, a titanium oxide layer 63 provided on the platinum layer 62 and containing titanium oxide ($TiO_2$) as a primary component, and the diffusion-preventing layer 64 provided on the titanium oxide layer 63 and containing iridium oxide ($IrO_x$) as a primary component. The reason the platinum layer 62 is provided is that platinum does not lose conductivity by a high-temperature heat treatment that is performed when the piezoelectric layer 70 is formed by firing a piezoelectric precursor film. In addition, the diffusion-preventing layer 64 is provided to prevent diffusion of components forming the piezoelectric layer 70 into the first electrode 60 by the high-temperature heat treatment performed to form the piezoelectric layer 70.

In addition, a crystalline seed layer 65 containing titanium oxide ($TiO_2$) as a primary component is provided between the first electrode 60 and the piezoelectric layer 70.

In addition, stress relieving holes 64*a* are provided to penetrate the diffusion-preventing layer 64 at predetermined intervals, and the titanium oxide layer 63 and the crystalline seed layer 65 provided at the two sides (a piezoelectric layer 70 side and the flow path forming substrate 10 side) of the diffusion-preventing layer 64 are in contact with each other through the stress relieving holes 64*a*.

The number and the size of the stress relieving holes 64*a* of the diffusion-preventing layer 64 are appropriately formed so as to prevent diffusion of the components, in particular lead, of the piezoelectric layer 70 to a first electrode 60 side (in particular, to an underlayer of the first electrode 60) when the piezoelectric layer 70 is crystallized by firing, which will be described later in detail. In particular, when the piezoelectric layer 70 is fired, the components thereof can be mostly prevented from diffusing to an underlayer side of the first electrode 60 by the diffusion-preventing layer 64; however, the components partly diffuse into the first electrode 60 (the flow path forming substrate 10 side further from the diffusion-preventing layer 64). In addition, problems may arise when the components of the piezoelectric layer 70 pass through the first electrode 60 and diffuse to the underlayers including the insulating film 55, the elastic film 50, and the flow path forming substrate 10, and hence the number and the size of the stress relieving holes 64*a* are preferably formed so that, although the components of the piezoelectric layer 70 diffuse into the first electrode 60, the components do not reach the underlayer side of the first electrode 60. In this embodiment, the size of the stress relieving hole 64*a* is preferably in the range of approximately several nanometers to several tens of nanometers.

In addition, the layers 61 to 64 forming the first electrode 60 and the crystalline seed layer 65 are formed by a manufacturing process, which will be described later, and are then processed by a heat treatment that is simultaneously performed when the piezoelectric layer 70 is crystallized and formed by firing the piezoelectric precursor film. That is, in this embodiment, as disclosed later in detail with reference to FIG. 5A, in order to form the first electrode 60 and the crystalline seed layer 65, before the piezoelectric layer 70 is formed, the first electrode 60 is formed by laminating a titanium layer 66 made of titanium (Ti), a platinum layer 67 made of platinum (Pt), and an iridium layer 68 made of iridium (Ir) in that order on the insulating film 55, and a crystalline seed layer 69 made of titanium is then formed. Subsequently, when the piezoelectric layer 70 is crystallized by firing, the first electrode is simultaneously processed by a heat treatment, and as a result, the first electrode 60 composed of the adhesion layer 61, the platinum layer 62, the titanium oxide layer 63, and the diffusion-preventing layer 64 and the crystalline seed layer 65 composed of titanium oxide are formed.

That is, the diffusion-preventing layer 64 is formed by thermal oxidation through a heat treatment simultaneously performed when the piezoelectric layer 70 is fired. In addition, by the stress relieving holes 64*a* provided in the diffusion-preventing layer 64, when the diffusion-preventing layer 64 is formed by thermal oxidation, an internal stress generated by expansion caused by the thermal oxidation is decreased by the stress relieving holes 64*a*. That is, when the piezoelectric layer 70 is fired, the iridium layer 68 made of iridium, which is formed before the piezoelectric layer 70 is fired, is simultaneously heated and oxidized so that the volume is increased by approximately 2.3 times, and as a result, the diffusion-preventing layer 64 is formed. At this stage, a stress applied to the platinum layer 62 and the like provided under the diffusion-preventing layer 64 and to a laminate film, such as the piezoelectric layer 70, provided on the diffusion-preventing layer 64 is significantly increased, and as a result, the laminate film, particularly the piezoelectric layer 70, is broken. However, when the stress relieving holes 64*a* are provided in the diffusion-preventing layer 64, the stress generated when the diffusion-preventing layer 64 is formed by oxidation can be decreased by the stress relieving holes 64*a*, and the influence of the stress of the diffusion-preventing layer 64 on the laminate films can be decreased. Accordingly, delamination of the first electrode 60, and peeling between the piezoelectric layer 70 and the first electrode 60 can be prevented, and in addition, the influence on crystal growth of the piezoelectric layer 70 is also decreased, so that the piezoelectric layer 70 can be formed to have superior properties. In addition, since the influence of the stress of the diffusion-preventing layer 64 on the piezoelectric layer 70 is decreased, the piezoelectric layer 70 itself can be prevented from being broken, and hence the durability thereof can also be improved.

In addition, the crystalline seed layer 65 may be provided in the form of titanium or titanium oxide before the piezoelectric layer 70 is fired. The crystalline seed layer 69 in the form of titanium that is formed before the piezoelectric layer 70 is fired preferably has a film density (Ti density) as high as possible and desirably has at least 4.5 $g/cm^3$ or more. The reason for this is that as the film density of the crystalline seed layer 69 is increased, the thickness of an oxide layer formed on the surface with the elapse of time can be suppressed small, and hence the crystal of the piezoelectric layer 70 is preferably grown. In addition, the film density of the crystalline seed layer 69 is determined by film-formation conditions regardless of the thickness. Furthermore, the crystalline seed layer 69 is preferably amorphous. In particular, the x-ray diffraction intensity of the crystalline seed layer 69, specifically the x-ray diffraction intensity (XRD intensity) of the (002) plane, is preferably substantially zero. The reason for this is that when the crystalline seed layer 69 is amorphous as described above, the film density thereof is increased, the thickness of the crystalline seed layer 65 formed on the surface is suppressed small, and as a result, the crystal of the piezoelectric layer 70 can be more preferably grown.

In addition, lead electrodes 90 made, for example, of gold (Au) are connected to the second electrodes 80 used for the respective piezoelectric elements 300, the lead electrodes 90 extending from the vicinities of the end portions at an ink supply path 14 side to the surface of the insulating film 55.

On the flow path forming substrate 10 on which the piezoelectric elements 300 are formed, that is, on the first electrode 60, the insulating film 55, and the lead electrodes 90, a protective substrate 30 having the reserve portion 31 forming at least part of a reserver 100 is bonded with an adhesive 35 provided therebetween. In this embodiment, this reserve portion 31 is formed along the width direction of the pressure generating chambers 12 to penetrate the protective substrate 30 in the thickness direction thereof and communicates with the communicating portion 13 of the flow path forming substrate 10 as described above so as to form the reserver 100 used as the common ink room for the pressure generating chambers 12. Alternatively, the communicating portion 13 of the flow path forming substrate 10 may be divided for the respective pressure generating chambers 12 so that only the reserve portion 31 is used as the reserver. Furthermore, for example, only the pressure generating chambers 12 are provided in the flow path forming substrate 10, and the ink supply paths 14 communicating between the reserver and the pressure generating chambers 12 may be formed in the member (for example, the elastic film 50 or the insulating film 55) located between the flow path forming substrate 10 and the protective substrate 30.

In addition, in a region of the protective substrate 30 facing the piezoelectric elements 300, a piezoelectric element holding portion 32 having a space so as not to inhibit the movement of the piezoelectric elements 300 is provided. The piezoelectric element holding portion 32 may have a space so as not to inhibit the movement of the piezoelectric elements 300, and the space may be sealed or may not be sealed.

As the protective substrate 30 described above, a material having a coefficient of thermal expansion approximately equivalent to that of the flow path forming substrate 10, such as a glass or a ceramic material, is preferably used, and in this embodiment, the protective substrate 30 is formed using the same silicon single crystal substrate as that for the flow path forming substrate 10.

In addition, a penetrating hole 33 penetrating the protective substrate 30 in the thickness direction thereof is provided. The end portion of the lead electrode 90 extending from each of the piezoelectric elements 300 is provided so as to be exposed in the penetrating hole 33.

In addition, a drive circuit 120 to drive the piezoelectric elements 300 disposed in parallel is fixed on the protective substrate 30. As this drive circuit 120, for example, a circuit substrate or a semiconductor integrated circuit (IC) may be used. In addition, the drive circuit 120 is electrically connected to the lead electrodes 90 through respective connection wires 121 each made of a conductive wire such as a bonding wire.

In addition, a compliance substrate 40 made of a sealing film 41 and a fixing plate 42 is bonded on the protective substrate 30 described above. In this case, the sealing film 41 is formed of a material having flexibility and a low rigidity, and one direction of the reserve portion 31 is sealed by this sealing film 41. In addition, the fixing plate 42 is formed of a relatively rigid material. A region of this fixing plate 42 facing the reserver 100 is an opening 43 that is formed by totally removing the fixing plate 42 in the thickness direction, and hence one direction of the reserver 100 is sealed only by the flexible sealing film 41.

In the ink jet recording head of this embodiment, after ink is supplied from an ink inlet port connected to external ink supply means (not shown in the figure), and the inside from the reserver 100 to the nozzle openings 21 is filled with ink, a voltage is applied between the first electrode 60 and the second electrode 80 corresponding to the pressure generating chamber 12 in accordance with a recording signal from the drive circuit 120 to deflect the elastic film 50, the insulating film 55, the first electrode 60, and the piezoelectric layer 70, and the inside pressure of each pressure generating chamber 12 is increased, so that an ink droplet is ejected from the nozzle opening 21.

Hereinafter, a method for manufacturing the above ink jet recording head will be described with reference to FIGS. 4A to 9B. In this case, FIGS. 4A to 9B are each a cross-sectional view of a pressure generating chamber in the longitudinal direction to illustrate a method for manufacturing an ink jet recording head which is one example of the liquid ejecting head according to an embodiment of the invention.

Figure 4A:
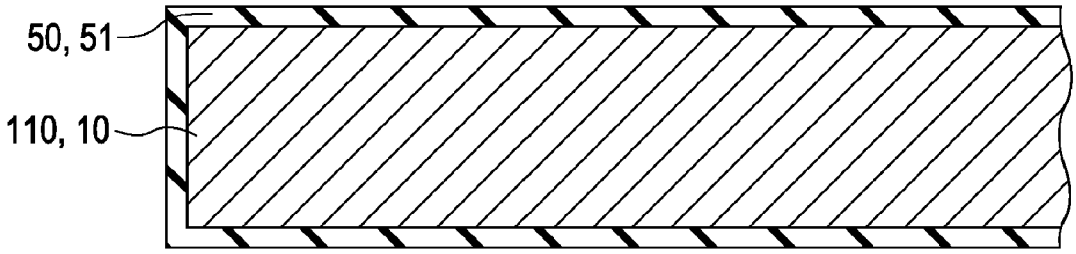
FIGS. 4A and 4B are cross-sectional views each showing a method for manufacturing the recording head according to Embodiment 1 of the invention.

First, as shown in FIG. 4A, an oxide film 51 forming the elastic film 50 is formed on a surface of a flow path forming-substrate wafer 110 which is a silicon wafer and on which a plurality of the flow path forming substrates 10 are integrally formed. A method for forming this oxide film 51 is not particularly limited, and for example, the oxide film 51 made of silicon dioxide ($SiO_2$) may be formed by performing thermal oxidation on the flow path forming-substrate wafer 110 in a diffusion furnace or the like.

Figure 4B:
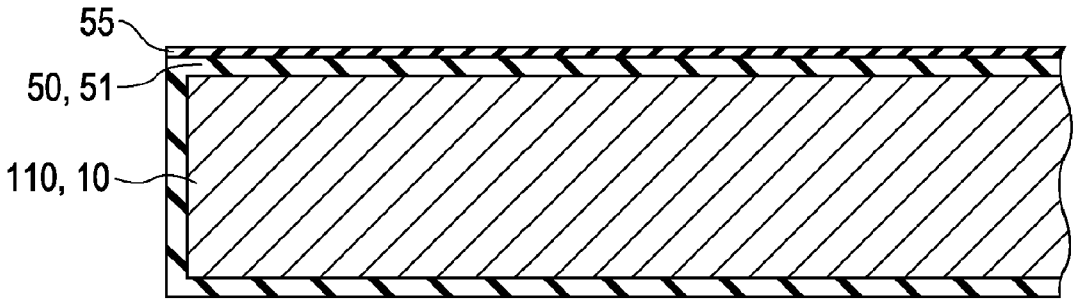

Subsequently, as shown in FIG. 4B, an oxide film made of a material different from that of the elastic film 50 is formed on the elastic film 50 (oxide film 51), and in this embodiment, the insulating film 55 made of zirconium oxide ($ZrO_2$) is formed. A method for forming this insulating film 55 is not particularly limited, and for example, after a zirconium (Zr) layer is formed on the elastic film 50 (oxide film 51), thermal oxidation may be performed in a diffusion furnace, for example, at 500 to 1,200° C. to form the insulating film 55 made of zirconium oxide ($ZrO_2$).

Figure 5A:
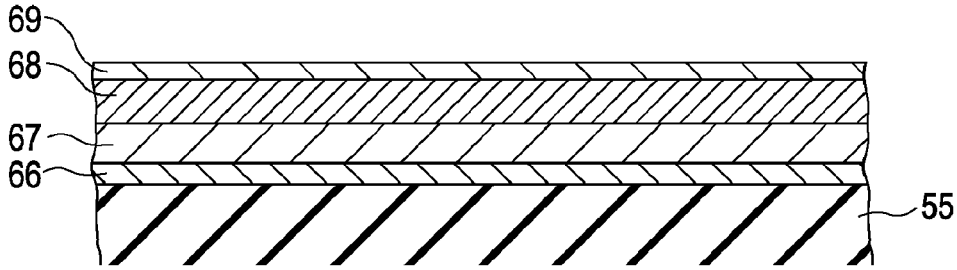
FIGS. 5A to 5C are cross-sectional views each showing the method for manufacturing the recording head according to Embodiment 1 of the invention.

Next, as shown in FIG. 5A, the titanium layer 66, the platinum layer 67, the iridium layer 68, and the crystalline seed layer 69 are sequentially formed on the insulating film 55.

In particular, the titanium layer 66 made of titanium (Ti) having a thickness of 10 to 50 nm is formed on the insulating film 55. In this embodiment, as the titanium layer 66, titanium (Ti) having a thickness of 20 nm is provided. When the titanium layer 66 is provided as the lowest layer of the first electrode, the adhesion between the insulating film 55 and the first electrode 60 can be increased. The titanium layer 66 is formed into the adhesion layer 61 and the titanium oxide layer 63, each forming the first electrode 60, by heating performed in a subsequent step.

Subsequently, the platinum layer 67 made of platinum (Pt) having a thickness of 50 to 500 nm is formed on the titanium layer 66. This platinum layer 67 is formed into the platinum layer 62 by heating simultaneously performed when the piezoelectric layer 70 is formed by firing through heating in a subsequent step. The reason the platinum layer 67 (platinum layer 62) is formed is that platinum exhibit a small change in conductivity caused by diffusion of lead oxide, and the thickness of the platinum layer 67 is also determined based on a desired conductivity of the first electrode 60.

In addition, the platinum layer 67 may be formed by a sputtering method or the like. In this embodiment, when the platinum layer 67 is formed by a sputtering method, by controlling the concentration of an inert gas (such as an argon gas), crystalline defects caused by argon (Ar) are generated, and titanium oxide (formed by oxidation of the titanium layer 66) present between the insulating film 55 and the platinum layer 67 diffuses into the platinum layer 67. When titanium oxide is allowed to diffuse into the platinum layer 67 as described above, the diffusion of titanium oxide contained therein is promoted when the piezoelectric layer 70 is fired by heating in a subsequent step, so that the stress relieving holes 64*a* can be formed in the iridium layer 68.

Next, the iridium layer 68 made of iridium (Ir) is formed on the platinum layer 67. The iridium layer 68 is provided to prevent diffusion of the components of the piezoelectric layer 70 to the first electrode 60 side, particularly, to the insulating film 55, the elastic film 50, and the flow path forming substrate 10 (flow path forming-substrate wafer 110), which are underlayers provided under the first electrode 60, when the piezoelectric layer 70 is formed by firing through heating performed in a subsequent step. In this embodiment, the iridium layer 68 is formed so as to have a thickness of 10 nm.

The iridium layer 68 is formed into the diffusion-preventing layer 64 containing iridium oxide ($IrO_x$) by heating simultaneously performed when the piezoelectric layer 70 is formed by firing through heating in a subsequent step.

Subsequently, the crystalline seed layer 69 made of titanium is formed on the iridium layer 68. In this case, the crystalline seed layer 69 is preferably amorphous. In particular, the x-ray diffraction intensity of the crystalline seed layer 69, specifically, the x-ray diffraction intensity (XRD intensity) of the (002) plane, is preferably substantially zero. The reason for this is that when the crystalline seed layer 69 is amorphous as described above, the film density thereof is increased, the thickness of an oxide layer formed on the surface is suppressed small, and as a result, the crystal of the piezoelectric layer 70 can be more preferably grown.

By providing the crystalline seed layer 69 on the first electrode 60 as described above, when the piezoelectric layer 70 is formed in a subsequent step on the first electrode 60 with the crystalline seed layer 69 provided therebetween, the preferential orientation of the piezoelectric layer 70 can be controlled along the (100) or the (111) plane, and the piezoelectric layer 70 can be obtained that is preferably used for an electromechanical transducer. In addition, the crystalline seed layer 69 functions as a seed to promote crystallization when the piezoelectric layer 70 is crystallized, and after the piezoelectric layer 70 is fired, the crystalline seed layer 69 partly diffuses therein and partly remains (the crystalline seed layer 65) on the first electrode 60 by thermal oxidation. In addition, in this embodiment, although titanium (Ti) is used for the crystalline seed layer 69, the material is not particularly limited thereto. Any material may be used for the crystalline seed layer 69 as long as it function as a nucleus of the crystal of the piezoelectric layer 70 when it is formed in a subsequent step, and for example, titanium oxide ($TiO_2$) may also be used for the crystalline seed layer 69.

Incidentally, the layers 66 to 68 forming the first electrode 60 and the crystalline seed layer 69 may be formed, for example, by a sputtering method, such as a DC magnetron sputtering method, or a chemical vapor deposition (CVD) method.

Next, a piezoelectric layer film 70 that is to be formed into the piezoelectric layers 70 and that is made of lead zirconate titanate (PZT) is formed. In this embodiment, the piezoelectric layer film 70 made of a metal oxide is obtained by using a so-called sol-gel method in which a so-called sol containing an organometallic compound dissolved or dispersed in a solvent is gelled by coating and drying, followed by performing firing at a high temperature. In addition, the method for manufacturing the piezoelectric layer film 70 is not limited to a sol-gel method, and for example, a metal-organic decomposition (MOD) method or a sputtering method may also be used.

Figure 5B:
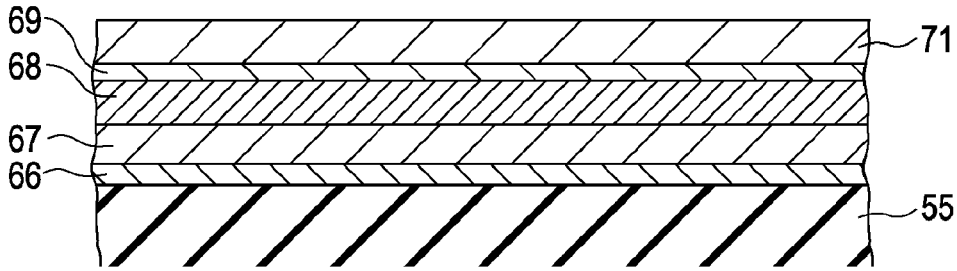

As a concrete process for forming the piezoelectric layer film 70, first, as shown in FIG. 5B, a piezoelectric precursor film 71 that is a PZT precursor film is formed on the crystalline seed layer 69. That is, a sol (solution) containing an organometallic compound is applied on the flow path forming substrate 10 on which the first electrode 60 is formed (coating step). Subsequently, this piezoelectric precursor film 71 is dried for a predetermined time by heating to a predetermined temperature (drying step). For example, in this embodiment, drying can be performed by maintaining the piezoelectric precursor film 71 at 150 to 170° C. for 8 to 30 minutes. Next, the dried piezoelectric precursor film 71 is heated to a predetermined temperature and is maintained for a predetermined time, so that degreasing is performed (degreasing step). For example, in this embodiment, degreasing is performed by heating the piezoelectric precursor film 71 to a temperature of approximately 300 to 400° C., followed by maintaining the temperature for approximately 10 to 30 minutes. In the degreasing in this embodiment, organic components contained in the piezoelectric precursor film 71 are removed, in the form of $NO_2$, $CO_2$, $H_2O$, and the like.

Figure 5C:
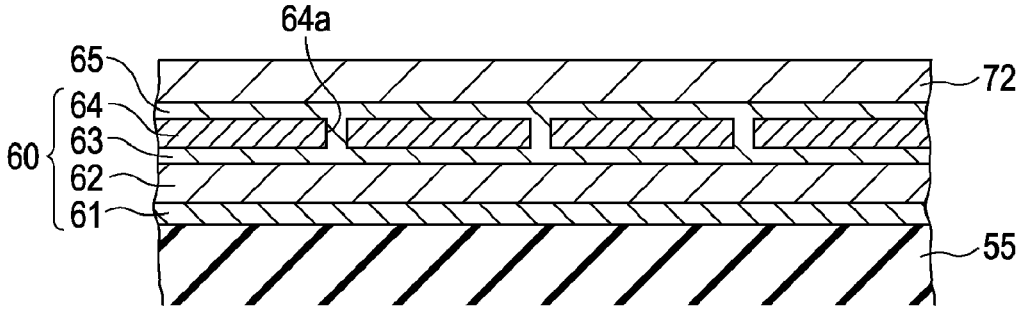

Next, as shown in FIG. 5C, the piezoelectric precursor film 71 is crystallized by heating to a predetermined temperature and is then maintained for a predetermined time, so that a piezoelectric film 72 is formed (firing step). In this firing step, the piezoelectric precursor film 71 is preferably heated to a temperature of 650 to 800° C., and in this embodiment, the piezoelectric precursor film 71 is fired in the above temperature range for 5 to 30 minutes to form the piezoelectric film 72. In addition, in the firing step, the temperature rise rate is preferably set to 15° C./second or less. Accordingly, the piezoelectric film 72 can be formed to have superior properties.

As a heating apparatus used in the drying step, the degreasing step, and the firing step, for example, a hot plate or a rapid thermal processing (RTP) apparatus performing heating by radiation of an infrared lamp may be used.

In addition, by the firing step performed to form the piezoelectric film 72 from the piezoelectric precursor film 71 by heating and firing, the first electrode 60 is simultaneously heated. At this stage, the titanium layer 66 partly remains to form the lowest layer of the first electrode 60, that is, to form the adhesion layer 61 at the interface between the platinum layer 62 and the insulating film 55. In addition, the titanium layer 66 partly diffuses into the platinum layer 67 to form the platinum layer 62 containing platinum (Pt) as a primary component and also to form the titanium oxide layer 63 at the interface between the platinum layer 62 the diffusion-preventing layer 64.

In addition, the indium layer 68 is broken through when titanium oxide (formed by oxidation of the titanium layer 66) that diffuses in the platinum layer 62 moves to the piezoelectric layer 70 side, so the stress relieving holes 64*a* are formed. In addition, the iridium layer 68 is formed into the diffusion-preventing layer 64 made of iridium oxide ($IrO_x$) by heating.

The stress relieving holes 64*a* are formed before iridium of the iridium layer 68 is completely turned into iridium oxide.

Iridium (Ir) is oxidized after the crystal growth of PZT starts. That is, at the initial stage at which PZT is generated, the iridium layer 68 of the first electrode contains no iridium oxide ($IrO_x$) but iridium (Ir). That is, since the iridium layer 68 is turned into the diffusion-preventing layer 64 containing iridium oxide as a primary component after PZT is crystallized (after the piezoelectric precursor film 71 is crystallized into the piezoelectric film 72), the stress of volume expansion caused by oxidation of iridium into iridium oxide imparts a significant influence on the crystallized piezoelectric film 72.

Hence, by providing the stress relieving holes 64*a* in the iridium layer 68 (diffusion-preventing layer 64), the stress of volume expansion caused by oxidation of the iridium layer 68 can be absorbed by the stress relieving holes 64*a*, and the influence of the stress caused by oxidation on the other layers of the first electrode 60 and the piezoelectric film 72 can be decreased. Accordingly, the stress applied to the adhesion layer 61 by volume expansion of the diffusion-preventing layer 64 can be decreased, and hence delamination of the first electrode 60 and degradation in adhesion between the first electrode 60 and the insulating film 55 can be prevented. In addition, by decreasing the stress applied to the piezoelectric film 72, the crystal growth of a second and subsequent piezoelectric films 72 is prevented from being inhibited, the breakage of the piezoelectric layer 70 is also prevented, and the durability thereof can be improved.

In addition, the crystalline seed layer 69 partly diffuses to the piezoelectric film 72 and remains in the form of titanium oxide ($TiO_x$) at the interface between the first electrode 60 and the piezoelectric layer 70 to form the crystalline seed layer 65. The crystalline seed layer 65 is formed in contact with the titanium oxide layer 63 through the stress relieving holes 64*a* of the diffusion-preventing layer 64. That is, the titanium oxide layer 63 and the crystalline seed layer 65 are continuously provided through the stress relieving holes 64*a* of the diffusion-preventing layer 64.

As described above, since the titanium oxide layer 63 and the crystalline seed layer 65 are formed in contact with each other through the stress relieving holes 64*a* provided in the diffusion-preventing layer 64, excess titanium (Ti) at a crystalline seed layer 65 (69) side is discharged to a titanium oxide layer 63 side through the stress relieving holes 64*a*. As a result, the formation of a region of the piezoelectric layer 70 at the crystalline seed layer 65 side in which the concentration of titanium is high in terms of the ratio of titanium to zirconium can be suppressed.

In the piezoelectric layer 70 in which the titanium concentration in terms of the ratio of titanium to zirconium is high, the piezoelectric properties thereof are degraded. In particular, in the piezoelectric layer 70 in which the ratio of titanium to zirconium (Ti/Zr) is considerably deviated from 0.5, the piezoelectric properties thereof are degraded. In order to crystallize the piezoelectric layer 70 to have a desired orientation, titanium used as a crystalline seed is required. Accordingly, after the piezoelectric layer 70 is once oriented, titanium used to control the orientation when the piezoelectric layer 70 is crystallized is not required; however, in general, this unnecessary titanium cannot be discharged from the piezoelectric layer 70.

However, according to the invention, by providing the stress relieving holes 64*a* in the diffusion-preventing layer 64, excess titanium at the crystalline seed layer 65 (69) side can be discharged to the titanium oxide layer 63 located at an opposite side to the piezoelectric layer 70 with respect to the diffusion-preventing layer 64 through the stress relieving holes 64*a*, and hence the titanium concentration of the piezoelectric layer 70, which is crystallized while the orientation is controlled, at the first electrode 60 side can be decreased. Accordingly, the piezoelectric layer 70 can be formed to have superior piezoelectric properties along the thickness direction thereof.

Figure 6A:
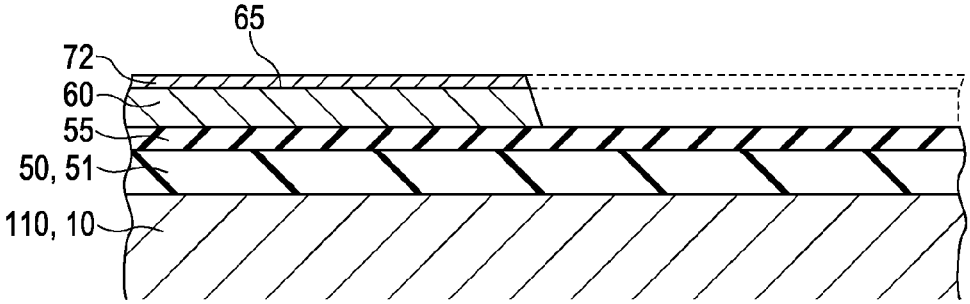
FIGS. 6A and 6B are cross-sectional views each showing the method for manufacturing the recording head according to Embodiment 1 of the invention.

Next, as shown in FIG. 6A, at the stage at which the first piezoelectric film 72 is formed on the first electrode 60, patterning is simultaneously performed so that the side surface of the first electrode 60 and that of the first piezoelectric film 72 are inclined. In this case, the patterning of the first electrode 60 and the first piezoelectric film 72 can be performed, for example, by dry etching, such as ion milling.

For example, in the case in which after the crystalline seed layer 69 is formed on the layers 66 to 68 forming the first electrode 60, and the layers 66 to 69 are patterned, the first piezoelectric film 72 is formed, since the layers 66 to 69 are patterned by a photolithographic step, an ion milling step, and an ashing step, the crystalline seed layer 69 is denatured. Since being formed on the denatured crystalline seed layer 69, the piezoelectric film 72 cannot have superior crystallinity. In addition, since the crystal growth of the second and subsequent piezoelectric films 72 is influenced by the crystalline conditions of the first piezoelectric film 72, the piezoelectric layer 70 cannot be formed to have superior crystallinity.

On the other hand, in the case in which after the first piezoelectric film 72 is formed, the first electrode 60 and the crystalline seed layer 65 are simultaneously patterned together with the first piezoelectric film 72, the first piezoelectric film 72 has superior properties as a seed to preferably grow the crystalline second and subsequent piezoelectric films 72 to those of the crystalline seed layer 65. Hence, even when a denatured film having a very small thickness is formed on the surface by patterning, the crystal growth of the second and subsequent piezoelectric films 72 is not considerably influenced.

Figure 6B:
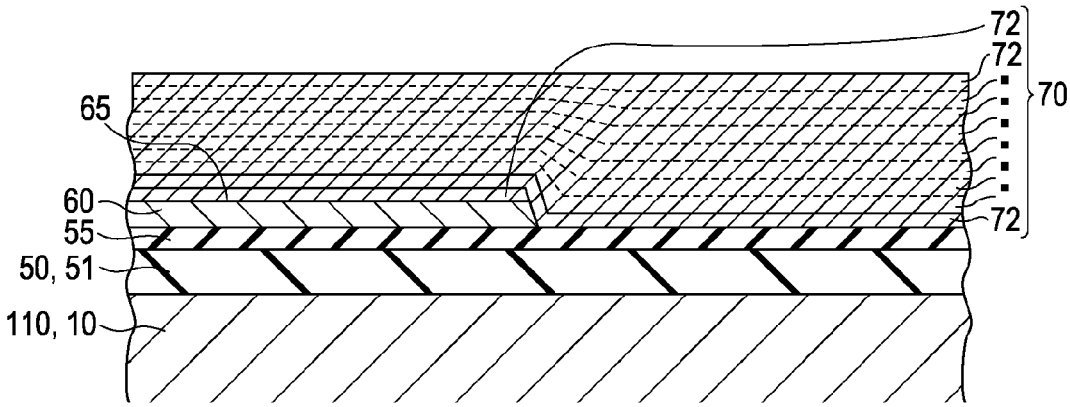

Subsequently, as shown in FIG. 6B, after the first piezoelectric film 72 and the first electrode 60 are patterned, a piezoelectric film forming process including the coating step, the drying step, the degreasing step, and the firing step described above is repeatedly performed, so that the piezoelectric layer film 70 including a plurality of the piezoelectric films 72 is formed. In this case, since the stress applied to the first piezoelectric film 72 is decreased by the diffusion-preventing layer 64 of the first electrode 60, crystal growth of the second and subsequent piezoelectric films 72 can be preferably performed, so that the piezoelectric layer 70 can be formed to have superior crystallinity.

Figure 7A:
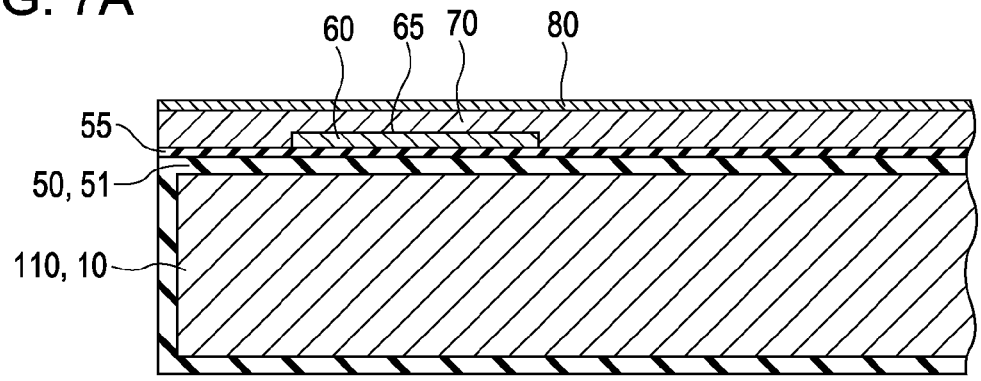
FIGS. 7A to 7C are cross-sectional views each showing the method for manufacturing the recording head according to Embodiment 1 of the invention.
Figure 7B:
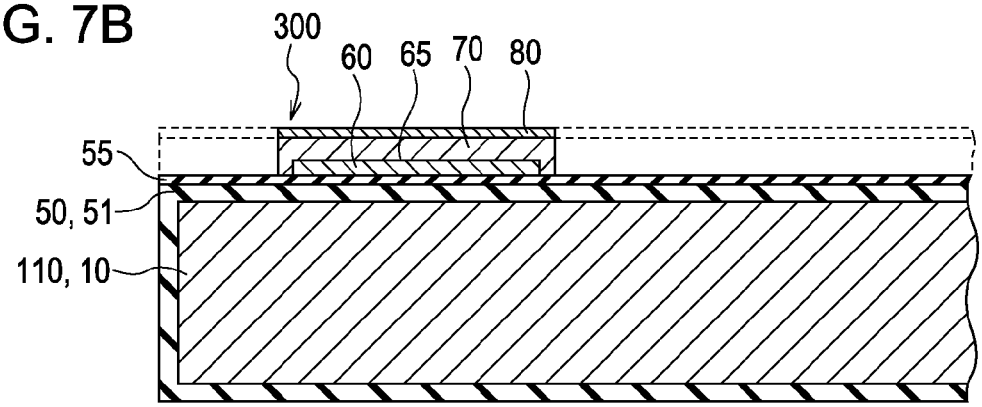

Next, after a second electrode film 80 that is formed into the second electrodes 80 and that is made, for example, of iridium (Ir) is formed over the piezoelectric layer film 70 as shown in FIG. 7A, the piezoelectric layer film 70 and the second electrode film 80 are patterned to correspond to the individual pressure generating chambers 12, so that the piezoelectric elements 300 are formed. As the patterning of the piezoelectric layer film 70 and the second electrode film 80, for example, dry etching, such as reactive ion etching or ion milling, may be mentioned.

Figure 7C:
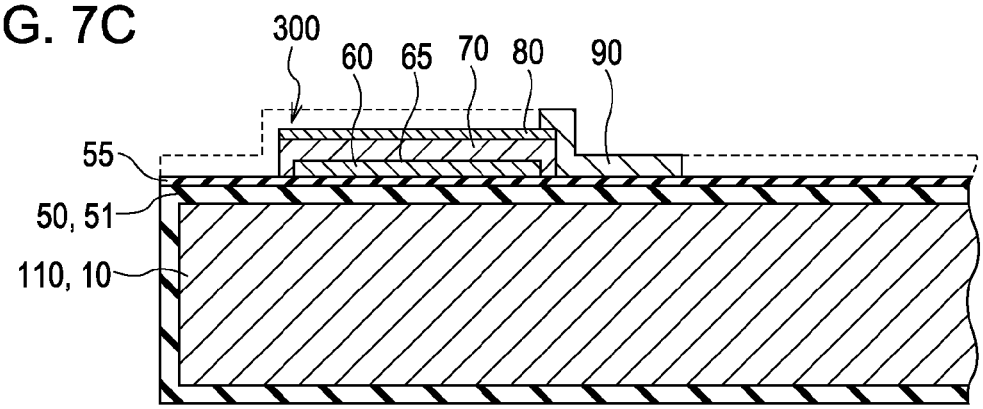

Next, the lead electrodes 90 are formed. In particular, as shown in FIG. 7C, after a lead electrode film 90 that is formed into the lead electrodes 90 and that is made, for example, of gold (Au) is formed over the entire surface of the flow path forming-substrate wafer 110, patterning is performed for the respective piezoelectric elements 300 using a mask pattern (not shown) made of a resist or the like, so that the lead electrodes 90 are formed.

Figure 8A:
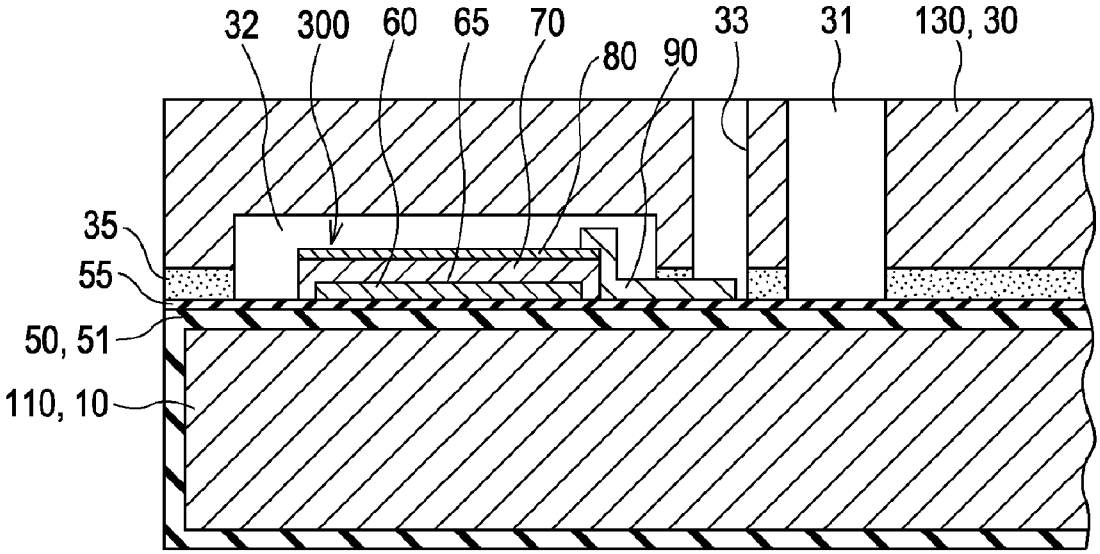
FIGS. 8A and 8B are cross-sectional views each showing the method for manufacturing the recording head according to Embodiment 1 of the invention.

Subsequently, as shown in FIG. 8A, a protective substrate wafer 130 that is a silicon wafer and is to be formed into a plurality of the protective substrates 30 is bonded to the flow path forming-substrate wafer 110 at a piezoelectric element 300 side with the adhesive 35 interposed therebetween.

Figure 8B:
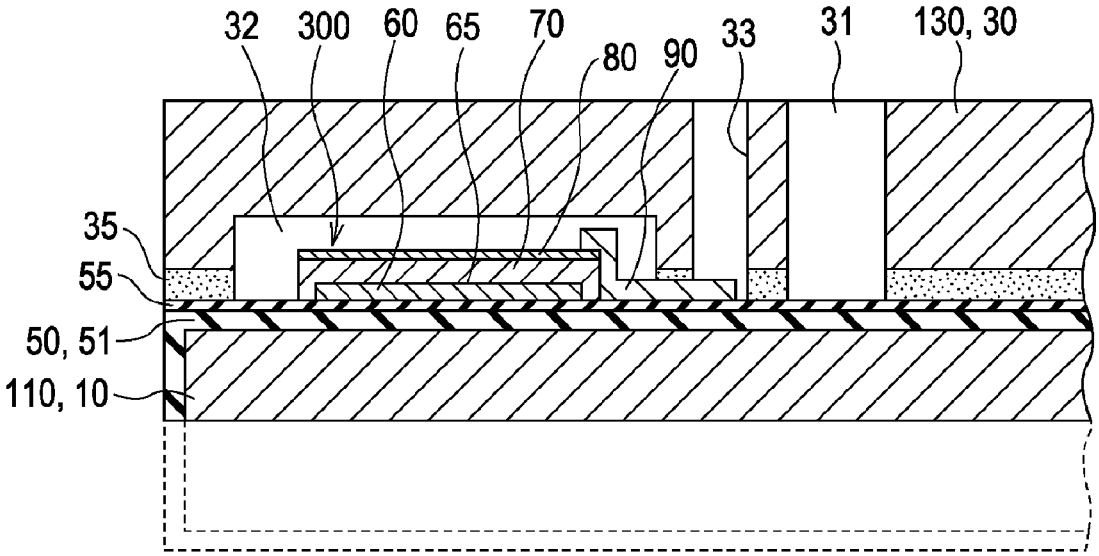

Next, as shown in FIG. 8B, the thickness of the flow path forming-substrate wafer 110 is decreased to a predetermined thickness.

Figure 9A:
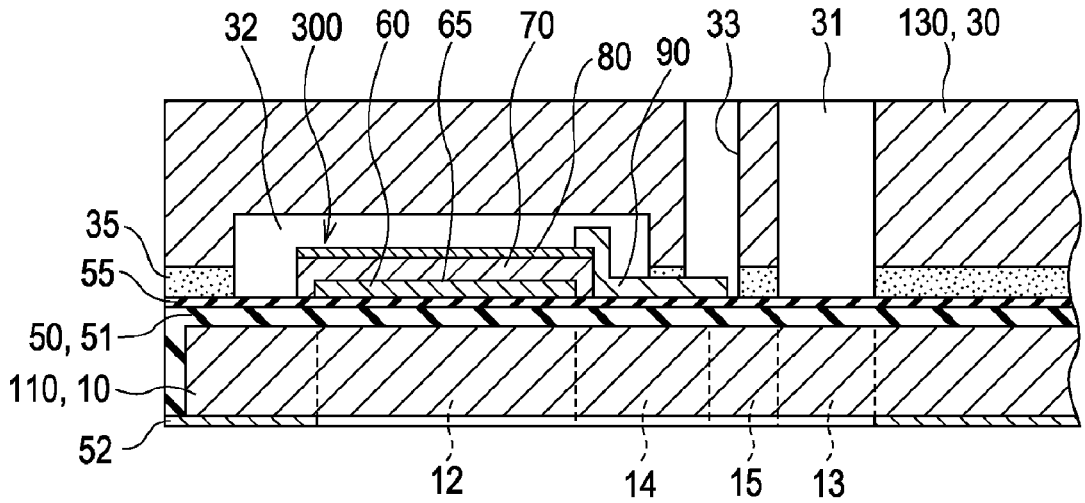
FIGS. 9A and 9B are cross-sectional views each showing the method for manufacturing the recording head according to Embodiment 1 of the invention.
Figure 9B:
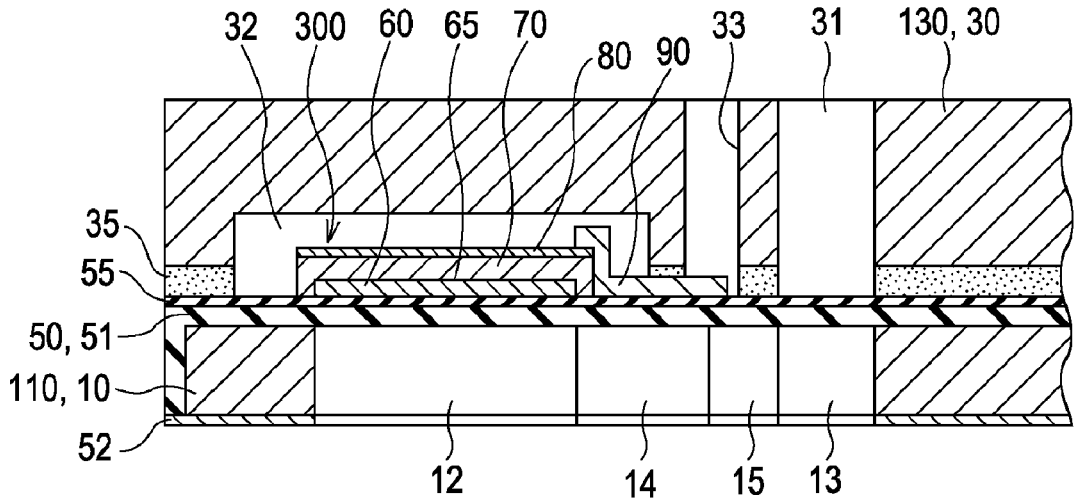

Subsequently, as shown in FIG. 9A, a mask film 52 is newly formed on the flow path forming-substrate wafer 110, and patterning is performed to have a predetermined shape. Next, as shown in FIG. 9*b*, an anisotropic etching (wet etching) using an alkaline solution containing KOH or the like is performed on the flow path forming-substrate wafer 110 using the mask film 52, so the pressure generating chamber 12, the communicating portion 13, the ink supply path 14, the communicating path 15, and the like, which form the corresponding piezoelectric element 130, are formed.

Subsequently, unnecessary peripheral portions of the flow path forming-substrate wafer 110 and the protective substrate wafer 130 are removed by cutting, such as dicing. Next, after the nozzle plate 20 in which the nozzle openings 21 are provided is bonded to the surface of the flow path forming-substrate wafer 110 at an opposite side to the protective substrate wafer 130, and the compliance substrate 40 is also bonded to the protective substrate wafer 130, the flow path forming-substrate wafer 110 and the like are divided, for example, into the flow path forming substrates 10 each having one chip size as shown in FIG. 1, so that the ink jet recording head I of this embodiment is formed.

As described above, in this embodiment, first, the titanium layer 66, the platinum layer 67, the iridium layer 68, those layers forming the first electrodes 60, and the crystalline seed layer 69 are formed on the flow path forming substrate 10 (flow path forming-substrate wafer 110). In this case, the concentration of an inert gas is increased when the platinum layer 67 is formed by a sputtering method, so that the components in the titanium layer 66 are allowed to diffuse in the platinum layer 67. Subsequently, since the piezoelectric layer 70 is crystallized and formed by firing through heating on the crystalline seed layer 69, the components of the titanium layer 66 are moved so as to pass through iridium layer 68 side (to the piezoelectric layer 70 side), so that the stress relieving holes 64*a* are formed in the iridium layer 68.

Since the diffusion-preventing layer 64 is formed by the steps of forming the stress relieving holes 64*a* in the iridium layer 68, and performing thermal oxidation thereof, even when the volume expansion occurs when the iridium layer 68 is formed into the diffusion-preventing layer 64, the stress caused thereby can be decreased by the stress relieving holes 64*a*. Accordingly, delamination in the first electrode 60 and degradation in adhesion between the first electrode 60 and the insulating film 55 can be prevented. In addition, since the influence of the stress caused by the diffusion-preventing layer 64 can be decreased, the piezoelectric layer 70 can be formed to have superior crystallinity, and the piezoelectric layer 70 can be prevented from being broken when it is repeatedly driven, so that the durability thereof can be improved.

In addition, since the stress relieving holes 64*a* are provided in the diffusion-preventing layer 64, excess titanium on the diffusion-preventing layer 64 can be moved to the titanium oxide layer 63 side under the diffusion-preventing layer 64 through the stress relieving holes 64*a*, and the formation of the region of the piezoelectric layer 70 at the crystalline seed layer 65 side in which the titanium concentration is high in terms of the ratio of titanium to zirconium can be suppressed.

Other embodiments

Heretofore, one embodiment of the invention has been described; however, the basic configuration of the invention is not limited thereto. For example, in the above Embodiment 1, as a method for forming the stress relieving holes 64*a* in the diffusion-preventing layer 64, the case is described in which titanium oxide that diffuses in the platinum layer 62 is used; however, the method is not limited thereto. For example, when the iridium layer 68 to be formed into the diffusion-preventing layer 64 is formed, the stress relieving holes 64*a* may be formed in advance by, for example, a photolithographic method.

In addition, for example, in the above Embodiment 1, as the flow path forming substrate 10, the silicon single crystal substrate is described by way of example; however, the flow path forming substrate 10 is not limited thereto. For example, a silicon single crystal substrate in which the crystalline orientation is along the (100) plane, the (110) plane, or the like may also be used, and in addition, a material, such as an SOI substrate or glass, may also be used.

Furthermore, in the above Embodiment 1, although the titanium oxide layer 63 forming a titanium oxide region is provided on the entire surface of the diffusion-preventing layer 64 opposite to the piezoelectric layer 70, the titanium oxide region may not be provided on the entire surface of the diffusion-preventing layer 64, that is, the titanium oxide region may be partly provided thereon in a dotted manner. Whether the titanium oxide region is provided in the form of a layer or is partly provided in a dotted manner is determined in accordance with the thickness of the adhesion layer 61 (titanium layer 66), the heat treatment temperature, and the like.

Figure 10:
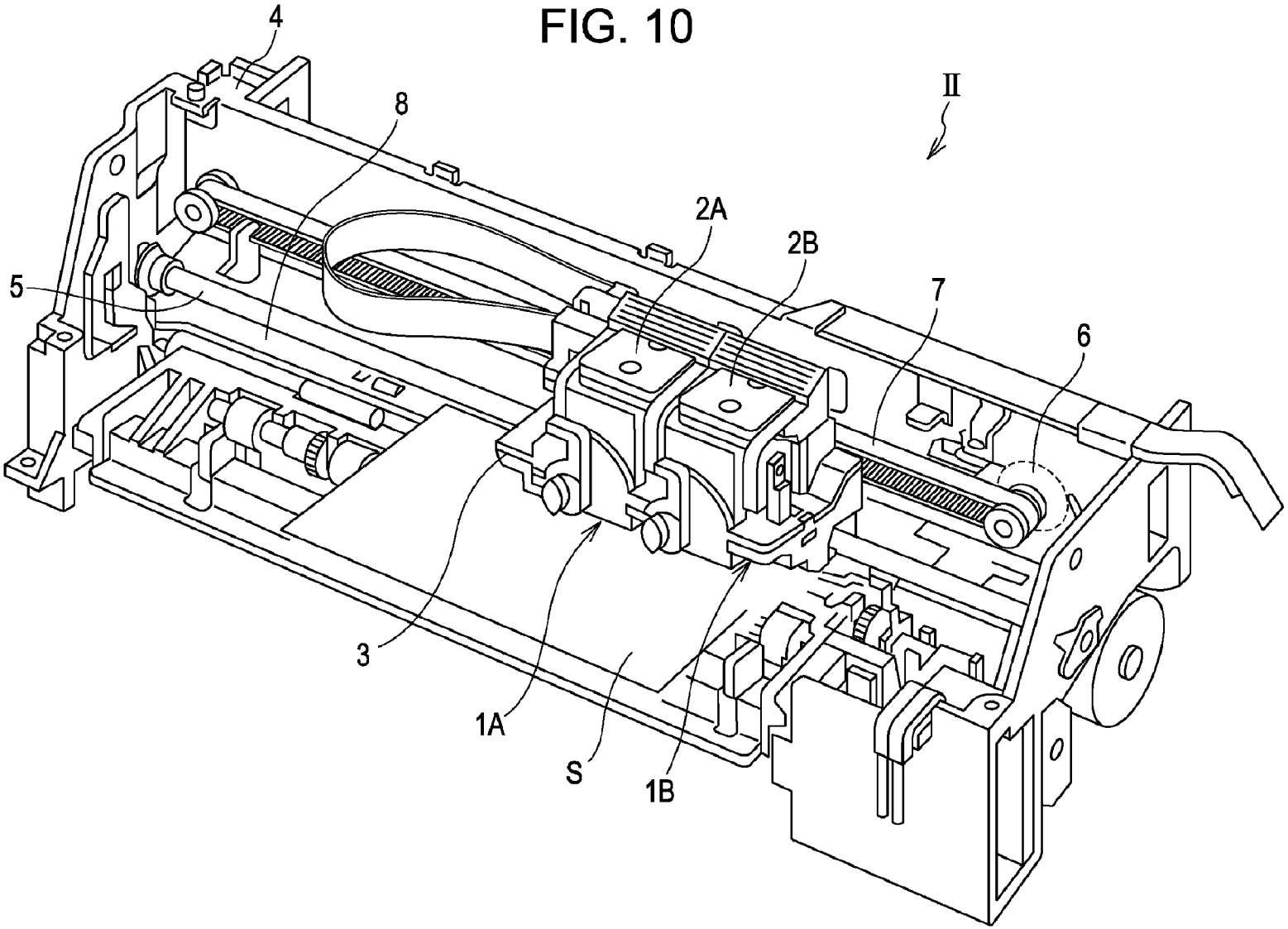
FIG. 10 is a perspective view showing a schematic structure of a recording apparatus according to one embodiment of the invention.

In addition, the ink jet recording head I described above partly forms a recording head unit having an ink flow path communicating with an ink cartridge and the like and is mounted in an ink jet recording apparatus. FIG. 10 is a schematic view showing one example of the ink jet recording apparatus.

In an ink jet recording apparatus II shown in FIG. 10, recording head units 1A and 1B each including the ink jet recording head I are detachably provided with cartridges 2A and 2B forming ink supply means, and a carriage 3 mounting these recording head units 1A and 1B is provided on a carriage shaft 5 fitted to an main frame body 4 so as to freely move along the shaft direction. The recording head units 1A and 1B are formed so as to eject, for example, a black ink composition and a color ink composition, respectively.

In addition, when a drive force of a drive motor 6 is transmitted to the carriage 3 through a plurality of gears (not shown) and a timing belt 7, the carriage 3 mounting the recording head units 1A and 1B is moved along the carriage shaft 5. In addition, a platen 8 is provided in the main frame body 4 along the carriage shaft 5, and a recording sheet S, which is a recording medium, such as paper, and which is supplied by a paper feed roller (not shown) or the like, is wound around the platen 8 so as to be transported.

In the above Embodiment 1, as one example of the liquid ejecting head, the ink jet recording head is described; however, since the invention has been conceived so as to be applied to any types of liquid ejecting heads, of course, the invention may also be applied to liquid ejecting heads ejecting liquids other than ink. As other liquid ejecting heads, for example, there may be mentioned various recording heads used in image recording apparatuses, such as a printer; color material ejecting heads used for manufacturing color filters of a liquid crystal display; electrode material ejecting heads used for forming electrodes of an organic EL display, a field emission display (FED), and the like; and bioorganic material ejecting heads used for forming biochips.

In addition, besides piezoelectric elements to be mounted in a liquid ejecting head represented by an ink jet recording head, the invention may also be applied to piezoelectric elements to be mounted in other apparatuses.

What is claimed is:

1. A liquid ejecting head comprising:

a pressure generating chamber communicating with a nozzle opening; and a piezoelectric element generating a pressure change in the pressure generating chamber, wherein the piezoelectric element includes a first electrode, a piezoelectric layer provided above the first electrode, and a second electrode provided above the piezoelectric layer at a side opposite to the first electrode, the first electrode has a diffusion-preventing layer containing iridium oxide as a primary component, and the diffusion-preventing layer has stress relieving holes that pass through in the thickness direction thereof and that are filled with a material other than iridium oxide.

2. The liquid ejecting head according to claim 1, further comprising a seed layer for crystallizing the piezoelectric layer containing titanium oxide as a primary component, wherein the diffusion-preventing layer of the first electrode is provided at a piezoelectric layer side, the seed layer is provided between the diffusion-preventing layer and the piezoelectric layer, and the first electrode includes a titanium oxide region that contains titanium oxide as a primary component and that is in contact with the crystalline seed layer through the stress relieving holes.

3. The liquid ejecting head according to claim 1, wherein the first electrode further has a platinum layer containing platinum as a primary component.

4. The liquid ejecting head according to claim 1, wherein the piezoelectric layer contains lead.

5. A liquid ejecting apparatus comprising:

a liquid ejecting head including:

a pressure generating chamber communicating with a nozzle opening; and a piezoelectric element generating a pressure change in the pressure generating chamber, wherein the piezoelectric element includes a first electrode, a piezoelectric layer provided above the first electrode, and a second electrode provided above the piezoelectric layer at a side opposite to the first electrode, the first electrode has a diffusion-preventing layer containing iridium oxide as a primary component, and the diffusion-preventing layer has stress relieving holes that pass through in the thickness direction thereof and that are filled with a material other than iridium oxide.

6. The liquid ejecting apparatus according to claim 5, wherein:

the liquid ejecting head further comprises a seed layer for crystallizing the piezoelectric layer containing titanium oxide as a primary component, the diffusion-preventing layer of the first electrode is provided at a piezoelectric layer side, the seed layer is provided between the diffusion-preventing layer and the piezoelectric layer, and the first electrode includes a titanium oxide region that contains titanium oxide as a primary component and that is in contact with the crystalline seed layer through the stress relieving holes.

7. The liquid ejecting apparatus according to claim 5, wherein the first electrode further has a platinum layer containing platinum as a primary component.

8. The liquid ejecting apparatus according to claim 5, wherein the piezoelectric layer contains lead.

9. A piezoelectric element comprising:

a first electrode;

a piezoelectric layer provided above the first electrode; and a second electrode provided above the piezoelectric layer at a side opposite to the first electrode, wherein the first electrode has a diffusion-preventing layer containing iridium oxide as a primary component, and the diffusion-preventing layer has stress relieving holes that pass through in the thickness direction thereof and that are filled with a material other than iridium oxide.

* * * * *